United States Patent [19]

Vass et al.

[11] 4,122,681

[45] Oct. 31, 1978

[54] MINE ROOF SUPPORT ASSEMBLY

[75] Inventors: George S. Vass, Summersville, W. Va.; Gerald M. Speidel, Strongsville, Ohio

[73] Assignee: The Eastern Company, Naugatuck, Conn.

[21] Appl. No.: 833,867

[22] Filed: Sep. 16, 1977

[51] Int. Cl.[2] ..... E21D 21/02

[52] U.S. Cl. ..... 405/261; 85/63; 151/21 B

[58] Field of Search ..... 61/45 B, 63; 151/21 B; 85/63, 84, 85

[56] References Cited

U.S. PATENT DOCUMENTS

| | | | |
|---|---|---|---|
| 3,507,313 | 4/1970 | Stockslager | 151/21 B |
| 3,674,075 | 7/1972 | Hoegee | 151/21 B |
| 3,747,656 | 7/1973 | Mortus | 151/21 B |
| 3,940,941 | 3/1976 | Libert et al. | 61/45 B |
| 3,967,455 | 7/1976 | Conway | 61/45 B |
| 4,051,683 | 10/1977 | Koval | 61/45 B |

*Primary Examiner*—Dennis L. Taylor

*Attorney, Agent, or Firm*—Charles S. McGuire

[57] ABSTRACT

A support assembly for a mine roof, or the like, including a bolt carrying a support plate for engagement with the roof surface, an internally threaded cylindrical collar, and an elongated bar. The bar and bolt are threaded into opposite ends of the collar, the bar being threaded to a fixed stop and the bolt being threaded to a deformation at an intermediate point along the length of the collar threads. A conventional resin package is inserted in the bore hole and the assembly inserted behind it with the end of the bar contacting the package to effect rupturing thereof and mixing of the contents. Rotation of the bolt is transmitted through the collar to the bar as the resin components are mixed due to engagement of the bolt with the deformation in the collar threads. After the resin has hardened the bar and collar cannot be further rotated. By application of a torque to the bolt head which exceeds the resistance provided by the thread deformation, the bolt may be advanced to the extent required to hold the support plate tightly against the roof.

1 Claim, 4 Drawing Figures

MINE ROOF SUPPORT ASSEMBLY

BACKGROUND OF THE INVENTION

The present invention relates to mine roof support systems and, more particularly, to bolting assemblies used in conjunction with resin anchoring systems.

Among the various types of rock reinforcing systems such as utilized, for example, in supporting mine roofs, is that wherein a plate is held against the roof surface by the head of a bolt which is securely anchored by means of a resin grout in a blind hole drilled for that purpose in the rock face. The resin is commonly provided in a rupturable package together with, but physically separated from, a catalyst, curing agent, or the like. The resin package is inserted in the hole ahead of the bolt which is forced into the package and rotated to rupture the package and mix the two components carried thereby.

In some prior art constructions, the portion of the bolt or bar which extends outside the drill hole after installation is threaded and a nut installed thereon for tightening into engagement with the support plate after the resin has hardened. The bolt anchoring systems of U.S Pat. Nos. 3,940,941 and 3,979,918, for example, are of this type. In other systems, such as those of U.S. Pat. Nos. 3,877,235 and 4,023,373, the end of the bolt which is inserted in the hole is threaded into a hollow member which is anchored in the hole by the resin grouting. In both of the aforementioned anchoring systems the end of the bar which is inserted into the hole is advanced into the resin package to rupture the compartment walls and rotated to mix the two components. Rotation of the bar and threaded member (whether the latter is outside or inside the drill hole) is effected as a single unit, i.e., there is no relative rotation of the two, as rupture of the resin package and mixing of the components is effected. Rotation is then halted as the mixed resin grout which has been described about the anchoring member for a portion of its length within the drill hole hardens. After a sufficient amount of hardening has taken place, torque is again applied, producing relative rotation between the bar or bolt and the threaded member.

In all of these aforementioned patents, means are provided for restraining relative rotational movement between the bolt or bar and the member threaded on one end or the other thereof during resin component mixing. Such means are releasable, however, to permit relative rotation upon the application of a predetermined excess torque to one member as the other is held stationary, as by the hardened resin grout. In Pat. No. 3,979,918 the releasable, relative-rotation restraining means is provided by a differential in thread pitch between the threaded end of the bar extending outside the hold and the nut threaded thereon. Alternatively, one end of the nut is deformed at several places about the periphery of the threaded opening by forming indentations in the face of the nut, which may then be threaded on the bolt until the deformed end is flush with the end of the bolt. Further relative rotation is restrained until an excess torque is applied to the nut while holding the bolt rotationally stationary.

In the anchoring systems of Pat. Nos. 3,877,235 and 4,023,373 the end of the bolt which is inserted into the drill hole is threaded into an internally threaded member which is inserted into the hole ahead of the bolt for engagement with the resin package at the inner end of the hole. In both patents means are provided to restrain rotational advancement of the bolt into the internally threaded member past a predetermined point. When this point is reached the bolt and member rotate as a single unit until the resin is mixed and hardened to anchor the internally threaded member in a fixed position. The application of excess torque to the bolt will then overcome the restraining means and permit rotation and threaded advancement of the bolt into the member, thereby bringing the support plate into engagement with the wall to be supported.

It is an object of the present invention to provide an improved bolt anchoring system of the resin grouted type utilizing a plate-supporting bolt and a resin-engaging reinforcing bar with an internally threaded collar having unique releasable relative-rotation restraining means.

Another object is to provide a resin-anchored rock bolting system wherein a collar, internally threaded at both ends, is used to join a rock bolt and reinforcing bar, and the rotational restraining means are incorporated without significantly affecting the manufacturing cost.

Still another object is to provide a rock bolting system having the aforementioned elements wherein the excess torque required to overcome the relative rotation restraining means may be easily varied and closely controlled in manufacture.

In a more general sense, the principal object is to provide a novel and improved resin grouted rock bolting system.

Other objects will in part be obvious and will in part appear hereinafter.

SUMMARY OF THE INVENTION

In accordance wih the foregoing objects, the invention contemplates a rock bolt assembly for use with a conventional, two-compartment resin package wherein a conventional, elongated bolt and reinforcing bar, each threaded externally at one end, are joined by a hollow, internally threaded collar. In the illustrated embodiment, the reinforcing bar or rebar, as it is commonly called, is turned down to a smaller diameter forming a stepped shoulder where the threaded portion meets the major portion of the bar. The rebar is threaded into one end of the collar as far as it will go, i.e., until the stepped shoulder on the bar meets the face of the collar.

At a predetermined distance from the end opposite that into which the rebar is threaded, the collar is struck at one or more places on its external surface with a force sufficient to inwardly deform the threaded internal surface. The inward deformation of the threads is sufficient to provide an obstacle to rotational advancement of the threaded end of the bolt into the collar. However, if the collar is held stationary, a torque within a predetermined range applied to the bolt will expand the internally deformed threads on the collar to allow further advancement of the bolt.

In operation, the rebar is securely threaded into one end of the collar, as previously noted, and the bolt is threaded into the other end until it meets the internal thread deformations. The resin package is then inserted into the previously formed drill hole and behind it the end of rebar, which serves to support the resin package and advance it to the blind end of the drill hole. Further advancement and rotation of the bolting assembly ruptures the resin package and mixes the contents of the two compartments thereof to form a hardenable mix. Rotation of the bolt head serves to rotate the collar and rebar during the mixing operation since no part of the bolting assembly is fixed to prevent rotation. After a few seconds, the two compartments of the resin grouting are thoroughly mixed and rotation is halted. When the resin has hardened sufficiently to restrain the rebar against further rotation, torque is again applied to the bolt head. Since the rebar cannot rotate, neither can the collar since it is threadedly engaged with the rebar as far as possible. Thus, when sufficient torque is applied to the bolt the thread deformation within the collar are expanded and the bolt may be advanced to bring the support plate carried by the bolt head securely against the surface surrounding the drill hole.

DETAILED DESCRIPTION

Figures 1, 2, 3, 4:
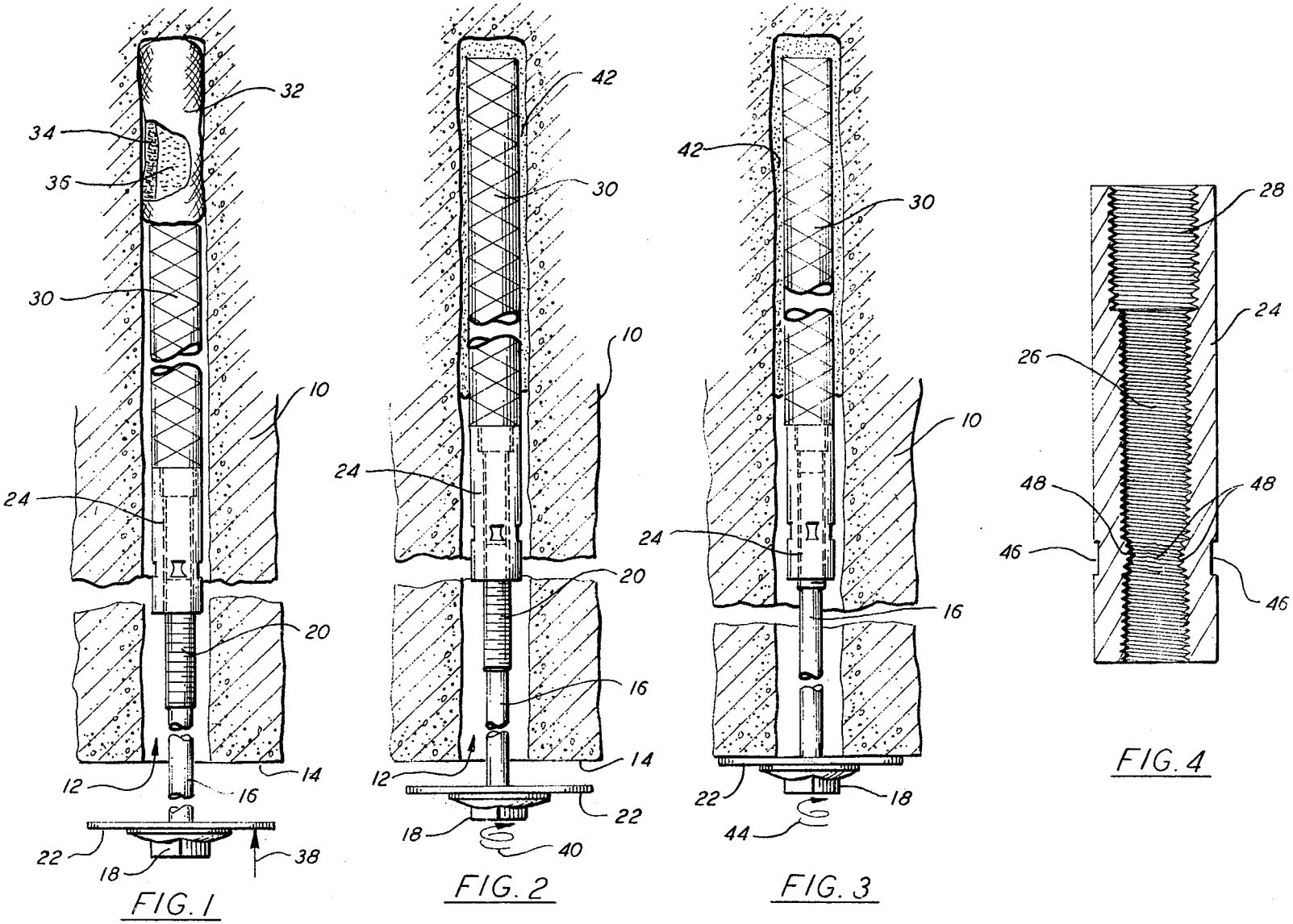
FIG. 1 is a cross sectional view through a rock structure having a drill hole formed therein showing, in front elevation, a conventional resin cartridge and the bolting assembly of the present invention at an initial stage of insertion and anchoring in the hole.
FIG. 2 is a like view, showing the elements at a subsequent stage of the anchoring operation.
FIG. 3 is a like view showing the elements in their final positions anchoring the bolt in the drill hole and supporting the rock structure.
FIG. 4 is an enlarged, elevational view, in half section, of one of the elements of the bolting assembly.

Referring now to the drawings, in FIGS. 1–3 is shown a cross section of rock structure 10, such as the roof of a coal mine, in which blind drill hole 12 has been formed with conventional drilling tools for the purpose of installing elements which will serve to support surface 14 and the surrounding rock structure. Elongated rock bolt 16, of standard construction, has a square (or otherwise shaped) head 18 at one end and is threaded for a portion of its length from the opposite end, as indicated at 20. Support plate 22 is carried in conventional manner by bolt head 18.

End 20 of bolt 16 is threaded into one end of cylindrical collar 24. As best seen in FIG. 4, collar 24 is entirely hollow, having a generally smooth outer surface and being threaded along the entire length of its internal surface. In the disclosed embodiment, collar 24 is threaded at two different internal diameters, having threads 26 over a major portion of its length for engagement by threaded end 20 of bolt 16, and threads 28 of slightly larger diameter. Elongated bar 30, preferably of a type used commercially in the reinforcement of concrete structures and therefore known as "rebar, " is turned down to a diameter smaller than that of the original bar for a relatively short portion of its length, thereby forming a stepped shoulder between the smaller and larger diameter portions. The smaller diameter, shorter portion is externally threaded for engagement with threads 28 of collar 24. In some applications, it may be convenient to form the external threads on rebar 30 without turning down the threaded end to a smaller diameter. In such cases, the stepped shoulder within the collar, i.e., the juncture between the two different thread diameters, may provide the stop means governing the maximum extent of threaded engagement of the collar and rebar. In fact, the collar and rebar may be permanently joined by other than threaded means since there is no requirement for relative rotation in their use.

Conventional resin cartridge 32 includes two compartments physically separating components 34 and 36 of a resin grouting mix. Such cartridges are commercially available from a variety of sources and include an epoxy or polyester resin as one of the components and a reaction agent such as a curing or hardening agent and/or a catalyst as the other. The two components remain in a semi-liquid or thixotropic phase until mixed, whereupon the resin begins to solidify. Curing and solidification continue until an extremely strong bond is formed to anchor the rebar in the drill hole.

As seen in FIG. 1, cartridge 32 has been placed in hole 12 and is supported therein upon the free end of rebar 30. Cartridge 32 is forced against the blind end of hole 12 as the bolting assembly comprising rebar 30, collar 24 and bolt 16 is moved upwardly as indicated by arrow 38 in FIG. 1. Bolt head 18 is engaged by a socket tool (not shown) such as employed in bolting machines commonly used in coal mines and elsewhere, which is power driven to move the bolting assembly upwardly into the drill hole and to rotate it in either direction.

Threads 26 and 28 within collar 24, and the cooperating threads on the ends of bolt 16 and rebar 30 are all cut in the same direction, whereby rotation imparted to bolt 16 which tends to advance it into collar 24 will impart a torque to the collar tending to tighten its threaded engagement with the end of rebar 30. However, since the rebar and collar have been threadedly engaged as far as possible prior to insertion in the drill hole, further relative rotation in such direction is not possible. Furthermore, since relative rotation between bolt 16 and collar 24 in a thread-advancing direction is constrained by the inward deformation of threads 26, the entire bolting assembly is rotated by a clockwise (thread-advancing) torque applied to bolt head 18, as indicated in FIG. 2 by arrow 40.

The walls of cartridge 32, including those separating components 34 and 36, are of plastic or other frangible material whereby, as the bolting assembly continues to be advanced after the cartridge has reached the blind end of the drill hole, the walls are broken and the two components may be mixed. Thus, in advancing the bolting assembly from the position of FIG. 1 to that of FIG. 2, the cartridge is ruptured and the components mixed to form a grout filling the space within hole 12 about the upper end of rebar 30, as indicated by reference numeral 42 in FIGS. 2 and 3. Rotation of the bolting assembly is then halted, with the socket tool remaining in engagement with the bolt head, as the resin mix begins to harden. After sufficient hardening has occurred, which is a function chiefly of the type of resin cartridge used and may be as little as 20 seconds or so, clockwise torque is again applied to bolt head 18. Since rebar 30 is now firmly anchored by resin grouting 42 and collar 24 cannot be further rotated in a clockwise direction relative thereto, a torque sufficient to force the end of bolt 16 into and through the deformations in threads 26 will allow the bolt to be rotated as indicated by arrow 44 and threadedly advanced into collar 24 until support plate 22 is firmly held by the bolt head against surface 14, as shown in FIG. 3.

An enlarged, sectional view of collar 24 is shown in FIG. 4. As illustrated, collar 24 has been struck on its external surface in four places, each about one inch from the end of the collar into which the bolt is threaded and spaced at 90° intervals about the collar. Indentations are thus formed on the outer surface of collar 24, two of such indentations being seen in the sectional view and indicated by reference numeral 46. Threads 25 are inwardly deformed adjacent each of indentation 46, as indicated in the areas denoted by reference numeral 48. Design factors for the tools to be used and the force with which collar 24 is struck in producing inward deformations 48 requiring a desired torque to overcome may be easily determined once the fixed parameters such as the material and thickness of collar 24 are established. For example, with a collar made of 1018 cold drawn steel having a wall thickness of 0.250 inches in the areas where indentations 46 and corresponding deformations 48 are formed, striking the external surface of collar 24 with a tool having a striking surface of approximately ½ inch length and ¼ inch width with a force of 3 to 4 tons at four places about the surface of the collar will produce deformations which are overcome by applying a torque of approximately 70 foot pounds to the bolt being threaded thereinto while holding the collar stationary. The process is repeatable so that the torque required to rotate the bolt of each bolting assembly past the deformations varies only slightly. The required torque may be easily varied for a collar of given thickness and material simply by varying the depth or number of deformations.

From the foregoing it is apparent that the present invention provides a novel bolting assembly for use in a resin grouted mine roof support system. The assembly utilizes a standard, externally threaded rock bolt and reinforcing bar with an internally threaded connecting collar having unique means for restraining relative rotation of the elements as a conventional resin cartridge is ruptured and the contents thereof mixed to form a resin grouting anchor for the assembly. After sufficient hardening of the resin grouting about the rebar, a predetermined excess torque applied to the bolt head overcomes the relative rotation restraining means, allowing the bolt to be advanced to bring the support plate into supporting engagement with the rock wall surface surrounding the drill hole in which the bolting assembly is anchored.

What is claimed is:

1. A method of reinforcing a rock formation comprising the steps of:

(a) forming a hollow collar, open at both ends and having coaxial, internal threads extending from both ends toward the center;

(b) striking the external surface of said collar with a die to cause inward deformation of said internal threads to an extent that a predetermined torque is required to produce relative rotation of said collar and an externally threaded member engaged therewith;

(c) advancing the externally threaded end of an elongated bolt into one end of said collar until the end of the bolt engages said inward thread deformation;

(d) advancing the externally threaded end of an elongated bar into the other end of said collar until fixed stop means prevent further advancement of said bar;

(e) drilling a hole of predetermined dimensions into a face of the rock formation;

(f) inserting a destructible resin cartridge into said hole;

(g) inserting said bar, collar and bolt into said hole behind said cartridge with the bolt head left outside;

(h) rotating the bolt head to cause common rotation of said bolt, collar and bar, thereby fracturing said resin cartridge and mixing the contents thereof within the hole around said bar;

(i) stopping rotation for a period of time sufficient for the resin mixture to harden about said bar, thereby preventing further rotation of said bar and of said collar in a direction tending to advance said bar further into said collar; and (j) applying to said bolt a torque in excess of said predetermined torque to advance the threaded end of said bolt into said collar past said inward thread deformation and engage the bolt head with structure engaging the face of said rock formation.

* * * * *